US007911424B2

(12) United States Patent
Chaussy et al.

(10) Patent No.: US 7,911,424 B2
(45) Date of Patent: Mar. 22, 2011

(54) AUTOMATIC ADAPTATION OF THE SUPPLY VOLTAGE OF AN ELECTROLUMINESCENT DISPLAY ACCORDING TO THE DESIRED LUMINANCE

(75) Inventors: Danika Chaussy, Bri Et Angonne (FR); Céline Mas, Poisat (FR)

(73) Assignee: STMicroelectronics S.A., Montrouge (FR)

( * ) Notice: Subject to any disclaimer, the term of this patent is extended or adjusted under 35 U.S.C. 154(b) by 1304 days.

(21) Appl. No.: 11/294,945

(22) Filed: Dec. 6, 2005

(65) Prior Publication Data

US 2006/0119551 A1 Jun. 8, 2006

(30) Foreign Application Priority Data

Dec. 6, 2004 (FR) ..... 04 52868

(51) Int. Cl.
*G09G 3/30* (2006.01)

(52) U.S. Cl. ..... 345/76; 345/82; 315/169.3

(58) Field of Classification Search ..... 345/76–83, 345/55, 30, 46, 84, 204, 212; 315/169.3
See application file for complete search history.

(56) References Cited

U.S. PATENT DOCUMENTS 6,518,962 B2 * 2/2003 Kimura et al. ..... 345/211
6,750,840 B2 * 6/2004 Morita ..... 345/100
2002/0097002 A1 7/2002 Lai et al.
2003/0184237 A1 10/2003 Togashi et al.
2004/0017725 A1 1/2004 Mas et al.
2005/0232333 A1 * 10/2005 Franch et al. ..... 374/178
2006/0001613 A1 * 1/2006 Routley et al. ..... 345/76

OTHER PUBLICATIONS

French Search Report from French Patent Application No. 04/52868, filed Dec. 6, 2004.

* cited by examiner

*Primary Examiner* — Amare Mengistu
*Assistant Examiner* — Kelly Hegarty
(74) *Attorney, Agent, or Firm* — Lisa K. Jorgenson; William R. McClellan; Wolf, Greenfield & Sacks, P.C.

(57) ABSTRACT

A device for regulating the bias voltage of circuits for controlling columns of a matrix display capable of selecting columns to turn on the light-emitting diodes of the selected columns and of a selected line, the device including a first measurement circuit providing a first measurement signal representative of the highest voltage among the voltages of the selected columns; a second measurement circuit providing a second measurement signal representative of the lowest voltage among the voltages of the selected columns; and an adjustment circuit receiving the first and second measurement signals and capable of decreasing the bias voltage if the first measurement signal is smaller than a first comparison signal and of increasing the bias voltage if the second measurement signal is greater than a second comparison signal.

19 Claims, 4 Drawing Sheets

AUTOMATIC ADAPTATION OF THE SUPPLY VOLTAGE OF AN ELECTROLUMINESCENT DISPLAY ACCORDING TO THE DESIRED LUMINANCE

BACKGROUND OF THE INVENTION

1. Field of the Invention

The present invention relates to electroluminescent display matrix screens formed of a set of light-emitting diodes. Such screens are for example formed of organic diodes ("OLED", for Organic Light Emitting Display) or polymer diodes ("PLED" for Polymer Light Emitting Display). The present invention more specifically relates to the regulation of the supply voltage of the control circuits of the light-emitting diodes of such screens.

2. Discussion of the Related Art

FIG. 1 shows a matrix screen comprised of n columns $C_1$ to $C_n$ and k lines $L_1$ to $L_k$ enabling addressing n*k light-emitting diodes d having their anodes connected to a column and their cathodes connected to a line.

Line control circuits $CL_1$ to $CL_k$ enable respectively biasing lines $L_1$ to $L_k$. A single line is activated at a time and is biased to ground. The non-activated lines are biased to a voltage $V_{ligne}$.

Column control circuits $CC_1$ to $CC_n$ enable respectively biasing columns $C_1$ to $C_n$. The columns addressing the light-emitting diodes which are desired to be activated are biased by a current to a voltage $V_{COL}$ greater than the threshold voltage of the screen light-emitting diodes. The columns which are not desired to be activated are grounded.

A light-emitting diode connected to the activated line and to a column biased to $V_{COL}$ is then on and emits light. Voltage $V_{ligne}$ is provided to be high enough for the light-emitting diodes connected to the non-activated lines and to the columns at voltage $V_{COL}$ not to be on and to emit no light.

FIG. 2 shows a conventional example of a column control circuit CC and of a line control circuit CL respectively addressing a column C and a line L connected to a light-emitting diode d of the screen. Line control circuit CL comprises a power inverter 1 controlled by a line control signal $\phi_L$. Power inverter 1 comprises an NMOS transistor 2 enabling discharging line L when $\phi_L$ is high and a PMOS transistor 3 enabling charging line L to bias voltage $V_{ligne}$ when $\phi_L$ is low.

Column control circuit CC comprises a current mirror formed in the present example with two PMOS-type transistors 4, 5. Transistor 4 forms the reference branch of the mirror and transistor 5 forms the duplication terminal. The sources of transistors 4 and 5 are connected to a bias voltage $V_{POL}$ on the order of 15 V for OLED screens. The gates of transistors 4 and 5 are interconnected. The drain and the gate of transistor 4 are interconnected. Transistor 4 is thus diode-connected, the source-gate voltage ($Vsg_4$) being equal to the source-drain voltage ($Vsd_4$). The drain of transistor 4 is connected to the source of a PMOS-type power transistor 6. The drain and the gate of transistor 6 are interconnected. The drain of transistor 6 is connected to a terminal of a current source 7 having its other terminal connected to ground GND. The current flowing through transistor 4 is set by current source 7 which provides a so-called "luminance" current $I_{LUM}$.

The drain of transistor 5 is connected to the source of a PMOS-type power transistor 8. The drain of transistor 8 is connected to column C. A switch 9, controlled by a control signal $\phi_C$, is capable of connecting the gate of transistor 8 to bias voltage $V_{POL}$, for example, when control signal $\phi_C$ is high, and to the gate of transistor 6 when control signal $\phi_C$ is low. When signal $\phi_C$ is low, transistor 8 is on and column C charges to reach voltage $V_{COL}$. When line L and column C are activated, line and column control signals $\phi_L$ and $\phi_C$ are respectively high and low, light-emitting diode d is on, and the current flowing through the diode is equal to luminance current $I_{LUM}$. The circuit for grounding column C when control signal $\phi_C$ is high is not shown.

For column control circuit CC to operate as described previously, it is necessary for voltage $V_{POL}$ to be sufficiently high for the copying of voltage $I_{LUM}$ to be correct. Bias voltage $V_{POL}$ is equal to the sum of drain-source voltage $Vds_2$ of transistor 2, of voltage $V_d$ across light-emitting diode d, of source-drain voltage $Vsd_8$ of transistor 8, and of source-drain voltage $Vsd_5$ of transistor 5.

When the copying of current $I_{LUM}$ is correct, transistor 5 is in saturation state and voltage $Vsd_5$ is at least equal to source-drain voltage $Vsd_4$ of transistor 4. A correct copying of the current in the duplication branch thus causes bias voltage $V_{POL}$ to be at least equal to the previously-mentioned sum when the current that it conducts is equal to luminance current $I_{LUM}$. If bias voltage $V_{POL}$ is too low, the current flowing through light-emitting diode d is smaller than current $I_{LUM}$ and the diode luminance is insufficient.

Luminance current $I_{LUM}$ provided by current source 7 may generally vary according to the luminance desired for the screen. When luminance current $I_{LUM}$ increases, source-drain voltage $Vsd_4$ of diode-assembled transistor 4 increases and voltage $V_d$ of light-emitting diode d also increases. As a result, bias voltage $V_{POL}$ must be high enough for transistor 5 to be in saturation whatever the luminance current.

However, for electric power saving reasons, bias voltage $V_{POL}$ is desired to be decreased, which then enables reducing voltage $V_{ligne}$ of the line control circuits.

There exist control circuits which have a fixed bias voltage $V_{POL}$ determined according to the maximum desired luminance current $I_{LUM}$. The disadvantage of such circuits is their high electric power consumption.

There exist other control circuits for which bias voltage $V_{POL}$ varies according to the desired luminance current $I_{LUM}$. If current $I_{LUM}$ is low, voltage $V_{POL}$ is low, and conversely. However, it is necessary to provide a security margin to take into account the aging of the screen light-emitting diodes. Indeed, for an equal current in light-emitting diode d, voltage $V_d$ across the diode increases along time. For the same luminance, corresponding to a given luminance current, the necessary minimum bias voltage $V_{POL}$ thus progressively increases with time. The obtained power savings for these circuits are thus not optimal.

SUMMARY OF THE INVENTION

An object of the present invention is to provide a device for regulating the bias voltage of column control circuits providing the lowest bias voltage $V_{POL}$ whatever the aging of the light-emitting diodes of the screen.

Another object of the present invention is to provide a device for regulating the bias voltage of control circuits of simple design.

To achieve these and other objects, the present invention provides a device for regulating the bias voltage of circuits for controlling columns of a matrix display formed of light-emitting diodes distributed in lines and in columns, the column control circuits being capable of selecting columns to turn on the light-emitting diodes of the selected columns and of a selected line of the matrix display, the device comprising a first measurement circuit providing a first measurement signal representative of the highest voltage among the voltages of the selected columns; a second measurement circuit providing a second measurement signal representative of the lowest voltage among the voltages of the selected columns; and an adjustment circuit receiving the first and second measurement signals and capable of decreasing the bias voltage if the first measurement signal is smaller than a first comparison signal and of increasing the bias voltage if the second measurement signal is greater than a second comparison signal.

According to an embodiment of the present invention, the adjustment circuit comprises a first storage circuit, capable of storing the first measurement signal for at least the duration of the display of an image on the matrix display in the absence of a new measurement of the first measurement signal; and a second storage circuit, capable of storing the second measurement signal for at least the duration of the display of an image on the matrix display in the absence of a new measurement of the second measurement signal.

According to an embodiment of the present invention, the first measurement circuit is capable of measuring the maximum voltage from among the voltages of the matrix display columns, the measurement circuit comprising a protection circuit capable of deactivating the measurement circuit for each column associated with a non-conductive light-emitting diode.

According to an embodiment of the present invention, the column control circuits are made in the form of a current mirror comprising a reference branch and several duplication branches connected to the bias voltage, each duplication branch being connected to a column, the reference branch comprising a field-effect PMOS-type reference transistor having its source connected to the bias voltage, and having its drain connected to a reference current source providing a current equal to a luminance current, the gate and the drain of the reference transistor being interconnected. Further, each duplication branch of the current mirror comprises a PMOS-type field-effect duplication transistor having its source connected to the bias voltage and having its drain connected to said column, the gates of the transistors of each branch being interconnected.

According to an embodiment of the present invention, the first measurement circuit comprises, for each column, a PMOS-type field-effect protection transistor having its source connected to the bias voltage and having its gate connected to the drain of the duplication transistor of the duplication branch associated with said column and an NMOS-type field effect measurement transistor, having its drain connected to the drain of the protection transistor and having its gate connected to the column, the sources of the first measurement transistors being connected to a measurement point.

According to an embodiment of the present invention, the reference branch further comprises a PMOS-type field-effect reference power transistor having its source connected to the drain of the reference transistor, the gate and the drain of the reference power transistor being connected to the reference current source. Each duplication branch further comprises a PMOS-type field-effect duplication power transistor having its source connected to the drain of the duplication transistor and having its drain connected to the column, and the gate of which is capable of being connected to the drain of the reference power transistor for selecting said column, the first comparison signal being the voltage at the drain of the reference power transistor.

According to an embodiment of the present invention, the second measurement circuit comprises, for each column, a PMOS-type field-effect measurement transistor having its drain connected to a reference voltage and having its gate connected to the column, the sources of the second measurement transistors being connected to a measurement point.

According to an embodiment of the present invention, the second comparison signal is equal to the bias voltage decreased by a determined constant voltage.

The present invention also provides a matrix display comprising light-emitting diodes distributed in lines and columns and column control circuits capable of selecting columns to turn on the light-emitting diodes of the selected columns and of a selected line, said matrix display further comprising a device for regulating the bias voltage of the column control circuits such as described hereabove.

The present invention also provides a method for regulating the bias voltage of circuits for controlling columns of a matrix display formed of light-emitting diodes distributed in lines and in columns, the column control circuits being capable of selecting columns to turn on the light-emitting diodes of the selected columns and of a selected line of the matrix display. The method comprises decreasing the bias voltage when the highest voltage among the voltages of the selected columns is smaller than a first comparison voltage and of increasing the bias voltage when the lowest voltage among the voltages of the selected columns is greater than a second comparison voltage.

According to an embodiment of the present invention, the column control circuits are made in the form of a current mirror comprising a reference branch and several duplication branches connected to the bias voltage, each duplication branch being connected to a column, the reference branch comprising a PMOS-type field-effect reference transistor having its source connected to the bias voltage, the gate and the drain of the reference transistor being interconnected, and a PMOS-type field-effect reference power transistor having its source connected to the drain of the reference transistor, the gate and the drain of the power transistor being connected to a reference current source providing a current equal to a predefined luminance current. Further, the first comparison signal is the voltage at the drain of the reference power transistor and the second comparison signal is the voltage at the drain of the reference transistor.

The foregoing and other objects, features, and advantages of the present invention will be discussed in detail in the following non-limiting description of specific embodiments in connection with the accompanying drawings.

DETAILED DESCRIPTION

Figure 1:
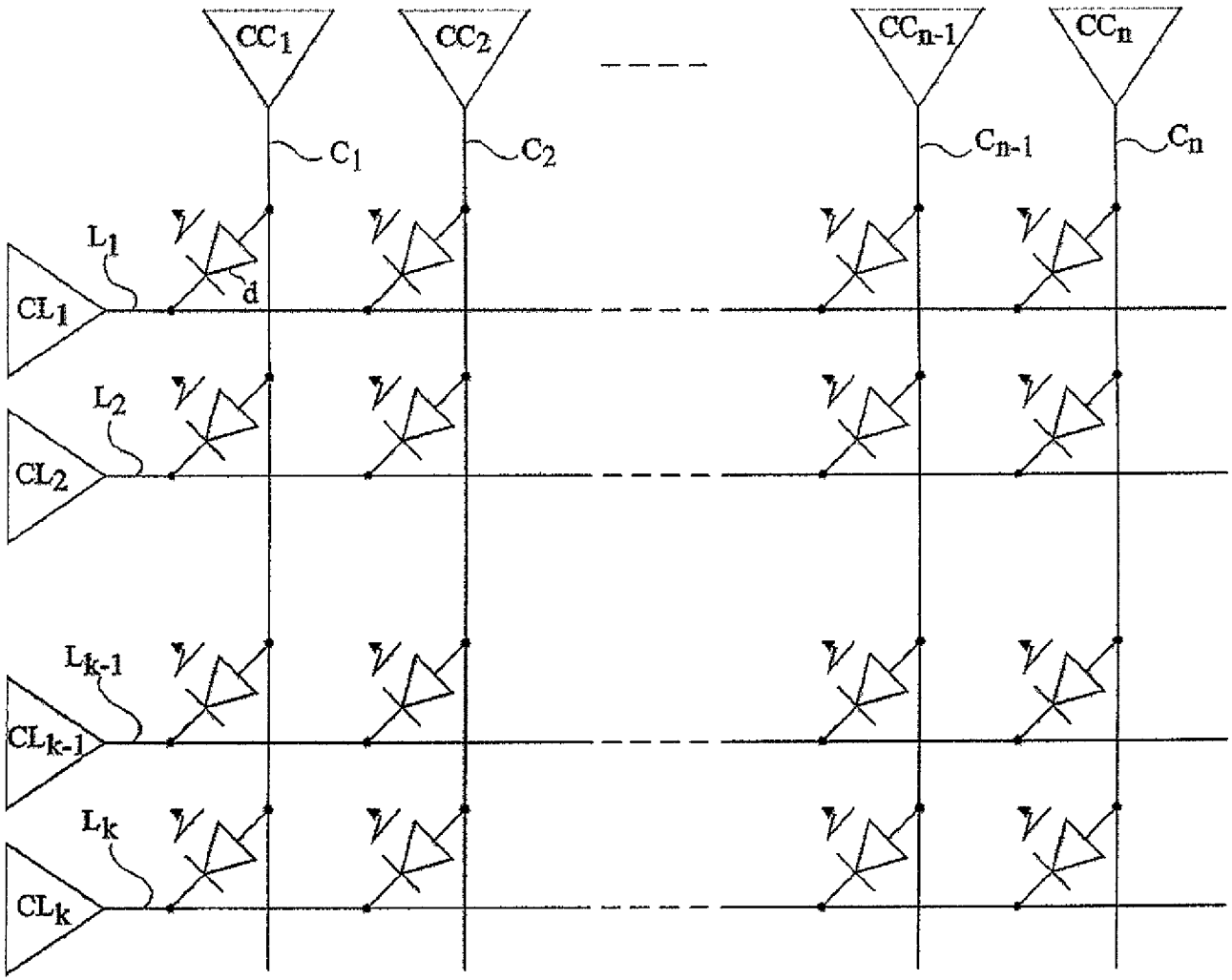
Fig 1 (Prior Art)
FIG. 1, previously described, shows an electroluminescent matrix display.
Figure 2:
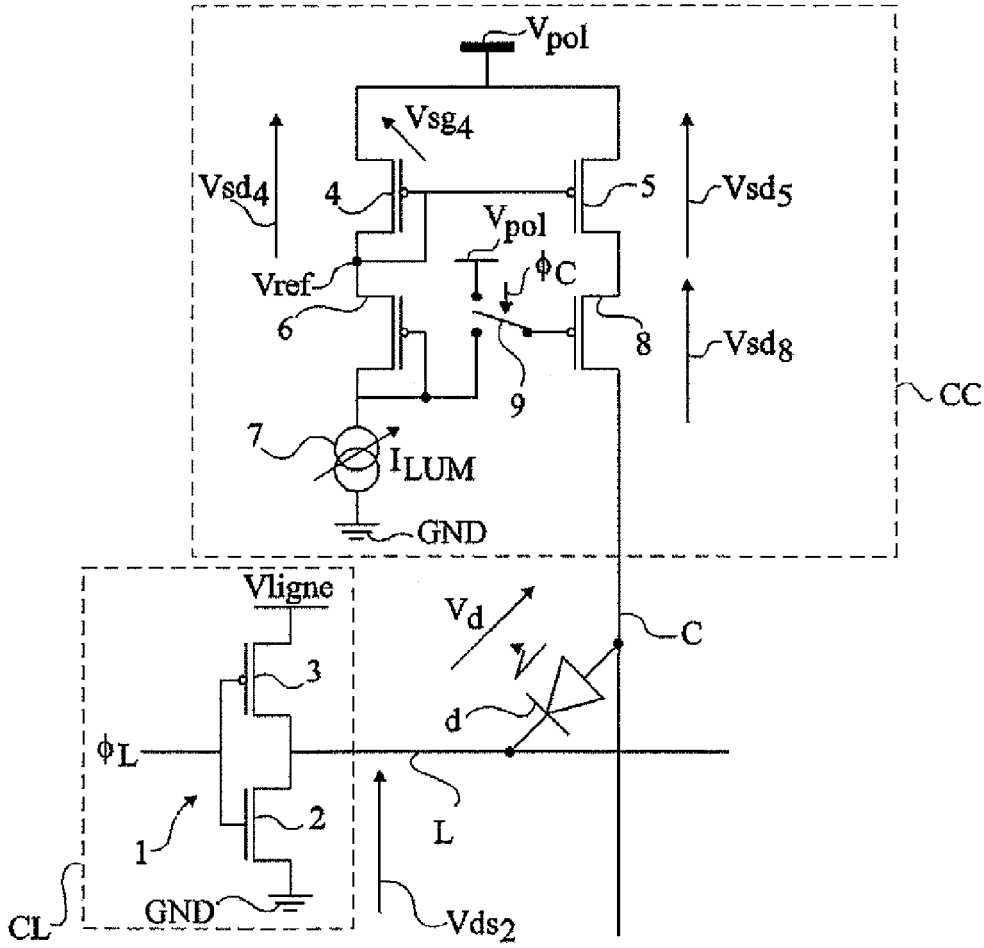
Fig 2 (Prior Art)
FIG. 2, previously described, shows a column control circuit and a line control circuit addressing a light-emitting diode of a screen.

For clarity, the same elements have been designated with the same reference numerals in the different drawings.

Figure 3:
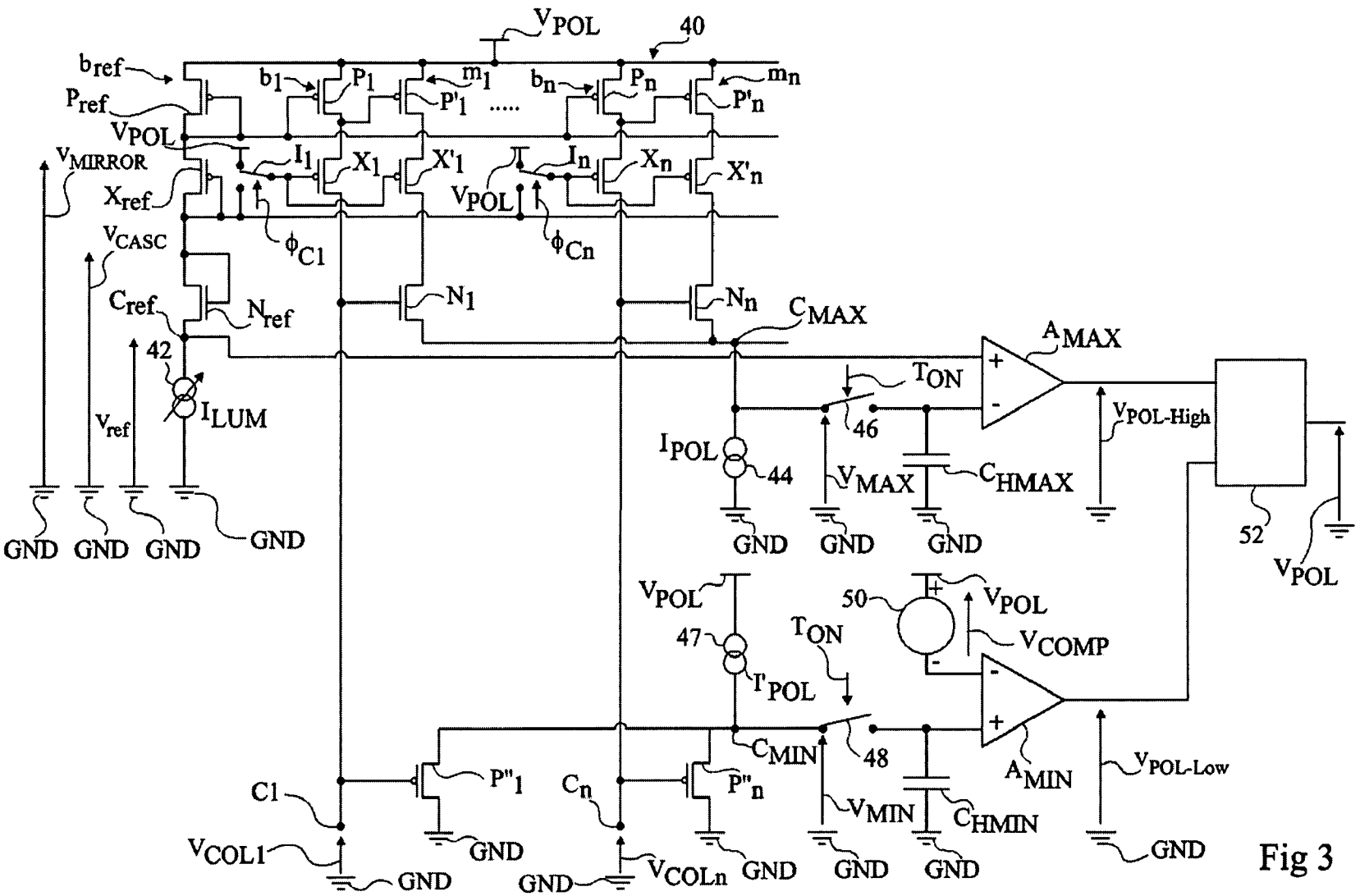
FIG. 3 illustrates an example of the forming of the regulation device according to the present invention.

FIG. 3 shows an example of the forming of column control circuits and of the regulation device according to the present invention.

The column control circuits comprise a current mirror 40 formed in the present example of a reference branch $b_{ref}$ and of n duplication branches $b_1$ to $b_n$. Each branch is formed of a PMOS transistor, $P_{ref}$ for the reference branch and $P_1$ to $P_n$ for branches $b_1$ to $b_n$. The sources of the transistors of each of the branches are connected to bias voltage $V_{POL}$ and the gates are interconnected. The drain and the gate of transistor $P_{ref}$ of reference branch $b_{ref}$ are connected to a source of a PMOS power transistor $X_{ref}$. The gate and the drain of power transistor $X_{ref}$ are interconnected. The drain of transistor $X_{ref}$ is connected to the drain of an NMOS transistor $N_{ref}$. The gate and the drain of transistor $N_{ref}$ are interconnected. The source of transistor $N_{ref}$ is connected to a terminal of a reference current source 42 at a point $C_{ref}$. The other terminal of current source 42 is connected to ground GND. After, the voltage between point $C_{ref}$ and ground GND is noted $V_{ref}$, the voltage between the drain of transistor $X_{ref}$ and ground GND is noted $V_{CASC}$, and the voltage between the drain of transistor $P_{ref}$ and ground GND is noted $V_{MIRROR}$.

Reference current source 42 provides a luminance current $I_{LUM}$. The drain of each transistor $P_i$, i ranging between 1 and n, is connected to the source of a PMOS power transistor $X_i$ having its drain connected to a column $C_i$. Each power transistor, $X_{ref}$ and $X_1$ to $X_n$, enables maintaining the voltage between the source and the drain of the transistor, $P_{ref}$ and $P_1$ to $P_n$, corresponding to the operating range of this transistor. The gate of each power transistor $X_i$, i ranging between 1 and n, is connected to a terminal of a two-position switch $I_i$, controlled by a signal $\phi_{Ci}$ and capable of connecting the gate of transistor $X_i$ to the drain of transistor $X_{ref}$, when signal $\phi_{Ci}$ is for example low, or to bias voltage $V_{POL}$, when signal $\phi_{Ci}$ is high. When signal $\phi_{Ci}$ is low, transistor $X_i$ is on and the voltage of column $C_i$ settles at operation voltage $V_{COLi}$ of the column while current $I_{LUM}$ flows through the column. The control circuits further comprise, for each column, a switch (not shown) capable of connecting column $C_i$ to ground GND.

The present invention comprises providing, for each duplication branch $b_i$, i ranging between 1 and n, a first measurement circuit $m_i$ comprising a PMOS transistor $P'_i$, having its source connected to bias voltage $V_{POL}$ and having its gate connected to the drain of transistor $P_i$ of the corresponding duplication branch $b_i$. The drain of each transistor $P'_i$ is connected to the source of a PMOS power transistor $X'_i$ having its gate connected to the gate of power transistor $X_i$ of the corresponding duplication branch $b_i$. Power transistor $X'_i$ enables maintaining the voltage between the source and the drain of the associated transistor $P'_i$ within the operation range of this transistor. The drain of each power transistor $X'_i$ is connected to the drain of a follower-assembled NMOS transistor $N_i$ having its gate connected to point $C_i$. The sources of transistors $N_1$ to $N_n$ are connected, at a point $C_{MAX}$, to a terminal of a current source 44 having its other terminal connected to ground GND. The voltage between point $C_{MAX}$ and ground GND is noted $V_{MAX}$. Current source 44 provides a bias current $I_{POL}$ for the biasing of NMOS transistors $N_1$ to $N_n$. A switch 46, controlled by a signal $T_{ON}$, enables connecting point $C_{MAX}$ to a terminal of a capacitor $C_{HMAX}$ having its other terminal connected to ground GND. The voltage across capacitor $C_{HMAX}$ drives the inverting input (−) of a comparator-assembled operational amplifier $A_{MAX}$. The non-inverting input (+) of amplifier $A_{MAX}$ is connected to point $C_{ref}$. Amplifier $A_{MAX}$ provides a binary control signal $V_{POL_High}$.

For each column $C_i$, with i varying from 1 to n, a second measurement circuit comprising a PMOS-type transistor $P''_i$ having its gate connected to column $C_i$ and having its drain connected to ground GND, is provided. The sources of transistors $P''_1$ to $P''_n$ are connected, at a point $C_{MIN}$, to a terminal of a current source 47 providing a current $I'_{POL}$ for the biasing of PMOS transistors $P''_1$ to $P''_n$. The voltage between point $C_{MIN}$ and ground GND is noted $V_{MIN}$. A switch 48, controlled by signal $T_{ON}$, enables connecting point $C_{MIN}$ to a terminal of a capacitor $C_{HMIN}$ having its other terminal connected to ground GND. The voltage across capacitor $C_{HMIN}$ drives the non-inverting input (+) of a comparator-assembled operational amplifier $A_{MIN}$. The inverting input (−) of amplifier $A_{MIN}$ is connected to a terminal of a constant voltage generator 50, providing a constant voltage $V_{COMP}$, having its other terminal connected to bias voltage $V_{POL}$. Amplifier $A_{MIN}$ provides a binary control signal $V_{POL_Low}$.

Control signals $V_{POL_High}$, $V_{POL_Low}$ are provided to an adjustment unit 52 which modifies the value of bias voltage $V_{POL}$ according to the values of the control signals.

The present invention comprises regulating bias voltage $V_{POL}$ so that, for each active column $C_i$, the voltage of column $V_{COLi}$ complies at best with the following relation:

$$V_{CASC}<V_{COLi}<V_{MIRROR}$$

Indeed, if voltage $V_{COLi}$ is smaller than $V_{CASC}$, this means that, for the considered column $C_i$, bias voltage $V_{POL}$ is unnecessarily too high. Further, if voltage $V_{COLi}$ exceeds $V_{MIRROR}$, then the current copying in column $C_i$ is incorrect since the source-drain voltage of transistor $P_i$ is smaller than the source-drain of transistor $P_{ref}$.

Practically, the highest voltage, noted $V_{COLMAX}$, among the voltages of active columns $C_1$ to $C_n$ is selected to be compared with voltage $V_{CASC}$ to determine whether bias voltage $V_{POL}$ is too high.

More specifically, in an activation phase, the voltage of each column $C_i$, with i varying from 1 to n, settles at a column voltage $V_{COLi}$ that can vary from one column to another. Transistors $N_1$ to $N_n$ being follower-assembled, voltage $V_{MAX}$ follows the highest voltage $V_{COLMAX}$ from among the voltages of $C_1$ to $C_n$. More specifically, voltage $V_{MAX}$ is equal to the difference between voltage $V_{COLMAX}$ and the gate-source voltage (imposed by $I_{POL}$) of transistor $N_i$ of column $C_i$ having the highest column voltage $V_{COLi}$. Switch 46 is on only when at least one pixel of a line is selected. In such a case, voltage $V_{MAX}$ is applied across capacitor $C_{HMAX}$. The turn-on time of switch 46 can vary but does not exceed the duration of an activation phase of a screen line to avoid discharging of capacitor $C_{HMAX}$ with current $I_{POL}$. Amplifier $A_{MAX}$ compares voltage $V_{MAX}$ with voltage $V_{ref}$. This amounts to comparing voltage $V_{COLMAX}$ with voltage $V_{CASC}$, considering that the gate-source voltages of transistor $N_{ref}$ and of transistors $N_1$ to $N_n$ are equal. Amplifier $A_{MAX}$ provides for example a control signal $V_{POL_High}$ at level "0" when voltage $V_{MAX}$ is greater than voltage $V_{ref}$ and a control signal $V_{POL_High}$ at level "1" when voltage $V_{MAX}$ is smaller than voltage $V_{ref}$.

Among the active columns, some may exhibit a defect of "open" pixel type. An "open" pixel corresponds to a cutting in the connection between the column and the anode of the light-emitting diode of the pixel or to a cutting in the connection between the line and the cathode of the light-emitting diode of the pixel. An open column $C_i$ being at high impedance, voltage $V_{COLi}$ of the column rises up to bias voltage $V_{POL}$. Voltage $V_{COLMAX}$ would then be equal to $V_{POL}$, which would be incorrect.

The device according to the present invention enables not taking into account an open column for the determination of $V_{COLMAX}$. Indeed, in the case of an "open" pixel, for example, the pixel of column $C_1$, when power transistor $X_1$ is on, the column being open and at high impedance, the voltage at the drain of transistor $P_1$ rises up to bias voltage $V_{POL}$. The voltage on the gate of transistor $P'_1$ is then equal to bias voltage $V_{POL}$ and transistor $P'_1$ is off. No current then flows through transistor $P'_1$. Transistor $N_1$ is then no longer supplied and can no longer charge capacitor $C_{HMAX}$.

However, with such a device, voltage $V_{COLMAX}$ thus obtained cannot be used to determine whether bias voltage $V_{POL}$ is too low. Indeed, if bias voltage $V_{POL}$ became too low, voltage $V_{COLi}$ of each active column $C_i$ would be equal to bias voltage $V_{POL}$ so that the associated transistor $P'_i$ would be off. Capacitor $C_{HMAX}$ would then be discharged by current $I_{POL}$ and voltage $V_{MAX}$ might decrease below voltage $V_{CASC}$, thus erroneously indicating that bias voltage $V_{POL}$ would be too high.

To determine whether bias voltage $V_{POL}$ is too low, the lowest voltage, noted $V_{COLMIN}$, from among the active columns voltages which is obtained separately from voltage $V_{COLMAX}$, is used. Voltage $V_{COLMIN}$ is then compared with voltage $V_{MIRROR}$ to determine whether bias voltage $V_{POL}$ is too low.

More specifically, transistors $P''_1$ to $P''_n$ being follower-assembled, voltage $V_{MIN}$ follows the lowest voltage $V_{COLMIN}$ from among the voltages of active columns $C_1$ to $C_n$. More specifically, voltage $V_{MIN}$ is equal to the sum of voltage $V_{COLMIN}$ and of the source-gate voltage of transistor $P''_i$ of column $C_i$ at voltage $V_{COLMIN}$. Theoretically, if it could be considered that the gate-source voltage of transistor $P_{ref}$ is equal to the gate-source voltage of transistor $P''_i$ of column $C_i$ at voltage $V_{COLMIN}$, comparing voltage $V_{COLMIN}$ with voltage $V_{MIRROR}$ would be equivalent to comparing $V_{MIN}$ with $V_{POL}$. In practice, to take transistor dispersions into account, $V_{MIN}$ is compared with a voltage which is smaller than bias voltage $V_{POL}$ by a constant voltage $V_{COMP}$, for example set to 300 mV. Amplifier $A_{MIN}$ compares voltage $V_{MIN}$ with voltage $V_{POL}-V_{COMP}$ and provides a control signal $V_{POL_Low}$ at "1" when voltage $V_{MIN}$ is greater than voltage $V_{POL}-V_{COMP}$ and a control signal $V_{POL_Low}$ at "0" when voltage $V_{MIN}$ is smaller than voltage $V_{POL}-V_{COMP}$.

By combining the information provided by control signals $V_{POL_High}$ and $V_{POL_Low}$, all cases can be addressed:

first case: bias voltage $V_{POL}$ is too low for the desired brightness level, which corresponds to $V_{POL_High}=0$ and $V_{POL_Low}=1$;

second case: bias voltage $V_{POL}$ is too high for the desired brightness level, which corresponds to $V_{POL_High}=1$ and $V_{POL_Low}=0$;

third case: bias voltage $V_{POL}$ is correct for the desired brightness level, which corresponds to $V_{POL_High}=0$ and $V_{POL_Low}=0$.

The capacitances of capacitors $C_{HMIN}$ and $C_{HMAX}$ are sufficiently high to limit leakages at the level of these capacitors at least for the time corresponding to the activation of all the screen lines. This enables providing a correct bias voltage $V_{POL}$ even in the case where a single screen line is lit in the display of an image on the screen.

Figure 4:
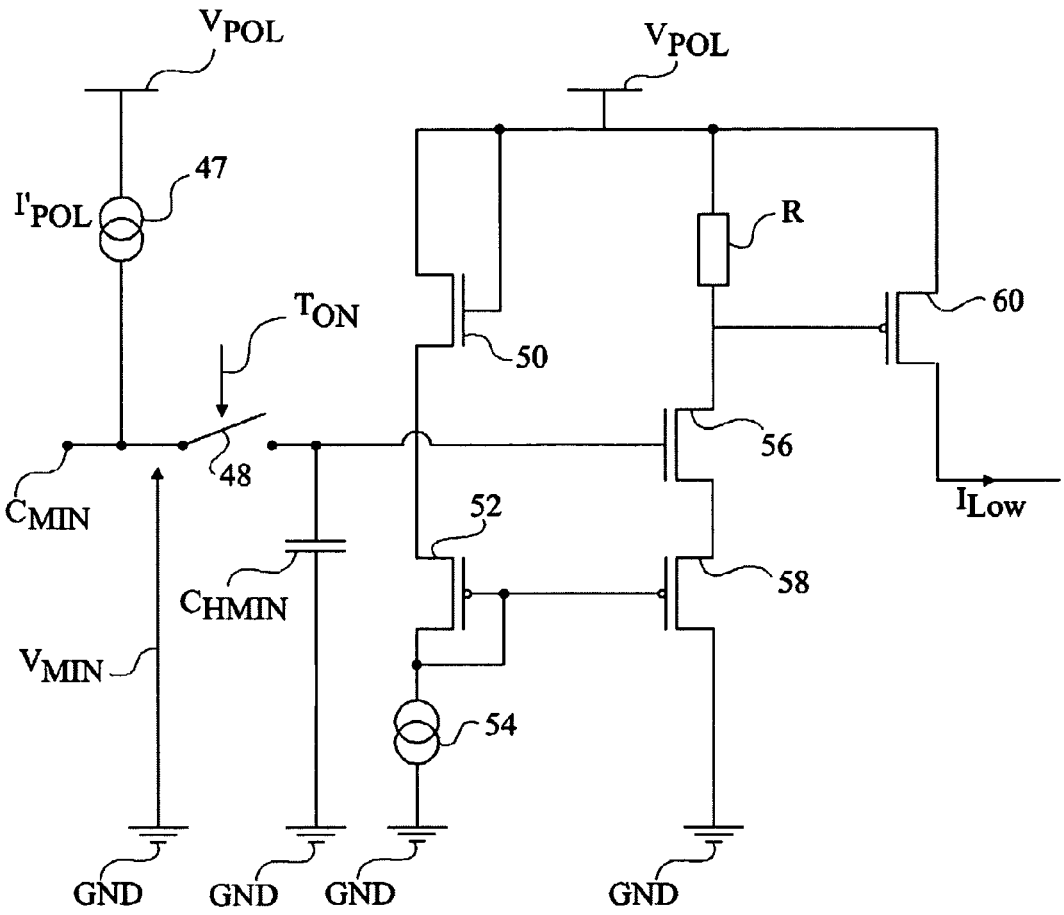
FIG. 4 illustrates a more detailed example of the forming of a portion of the device of FIG. 3.

FIG. 4 shows an example of the forming of a circuit corresponding to comparator $A_{MIN}$ and to constant voltage source $V_{COMP}$.

The circuit comprises an NMOS transistor 50 having its drain and gate connected to bias voltage $V_{POL}$. The source of transistor 50 is connected to the source of a PMOS transistor 52. The gate and the drain of transistor 52 are connected to a terminal of a constant current source 54 having its other terminal connected to ground GND. The circuit comprises an adjustable resistor R having a terminal connected to bias voltage $V_{POL}$ and having its other terminal connected to the drain of an NMOS transistor 56. The gate of transistor 56 corresponds to the non-inverting input (+) of amplifier $A_{MIN}$ of FIG. 3. The source of transistor 56 is connected to the source of a PMOS transistor 58. The gate of transistor 58 is connected to the gate of transistor 52 and the drain of transistor 58 is connected to ground GND. The drain of transistor 56 is connected to the gate of a PMOS transistor 60 having its source connected to bias voltage $V_{POL}$. Current $I_{Low}$ at the drain of transistor 60 provides control signal $V_{POL_Low}$ after current-to-voltage conversion.

As an example, assume that column voltage $V_{COL1}$ associated with column $C_1$ has the lowest operation voltage $V_{COLMIN}$. It is considered that the voltage of column $C_1$ must remain lower than $V_{MIRROR}$, that is, than the sum of voltage $V_{CASC}$ and of the gate-source voltage of transistor $X_{ref}$, since beyond this value, the copying is poor. Voltage $V_{MIRROR}$ is also equal to the difference between bias voltage $V_{POL}$ and the gate-source voltage of transistor $P_{ref}$. When voltage $V_{COL1}$ reaches this limit, voltage $V_{MIN}$ applied across capacitor $C_{HMIN}$ is equal to voltage $V_{POL}-Vgs_{Pref}+Vgs_{P''1}$, that is, equal to $V_{POL}$ if the two gate-source voltages are considered as identical.

As long as voltage $V_{MIN}$ is smaller than $V_{POL}$, transistor 58 is off and current $I_{Low}$ is zero. When voltage $V_{MIN}$ is greater than $V_{POL}$, a current flows through transistor 58 and thus through power transistor 60. Current $I_{Low}$ coming out of the drain of transistor 60 can then be turned into a voltage to obtain control signal $V_{POL_Low}$. In practice, the gate-source voltages of transistors $P_{ref}$ and $P''_1$ are not perfectly identical and voltage $V_{MIN}$ is rather compared with voltage $V_{POL}-V_{COMP}$, where voltage $V_{COMP}$ is positive, to take into account dispersions on the different transistors. The dimensions of transistors 50 and 56 and the value of resistor R are then adjusted to adjust the comparator gain and the voltage for which it switches.

Of course, the present invention is likely to have various alterations, modifications, and improvements which will readily occur to those skilled in the art. In particular, the current mirrors may be formed with a greater number of transistors per branch.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A device for regulating the bias voltage of circuits for controlling columns of a matrix display formed of light-emitting diodes distributed in lines and in columns, the column control circuits configured to select columns to turn on the light-emitting diodes of the selected columns and of a selected line of the matrix display, the device comprising:

a first measurement circuit providing a first measurement signal representative of a highest voltage among voltages of the selected columns;

a second measurement circuit-configured to measure the voltages of the selected columns and to provide a second measurement signal representative of a single lowest voltage among the voltages of the selected columns; and an adjustment circuit receiving the first and second measurement signals and configured to decrease the bias voltage if the first measurement signal is smaller than a first comparison signal and to increase the bias voltage if the second measurement signal is greater than a second comparison signal.

2. The device of claim 1, wherein the adjustment circuit comprises:

a first storage circuit, configured to store the first measurement signal for at least the duration of the display of an image on the matrix display in the absence of a new measurement of the first measurement signal; and a second storage circuit, configured to store the second measurement signal for at least the duration of the display of an image on the matrix display in the absence of a new measurement of the second measurement signal.

3. The device of claim 1, wherein the first measurement circuit is configured to measure the maximum voltage from among the voltages of the matrix display columns, the first measurement circuit comprising a protection circuit configured to deactivate the first measurement circuit for each column associated with a non-conductive light-emitting diode.

4. The device of claim 2, wherein the column control circuits are made in the form of a current mirror comprising a reference branch and several duplication branches connected to the bias voltage, each duplication branch being connected to a column, the reference branch comprising a field-effect PMOS-type reference transistor having its source connected to the bias voltage, and having its drain connected to a reference current source providing a current equal to a luminance current, the gate and the drain of the reference transistor being interconnected, and wherein each duplication branch of the current mirror comprises a PMOS-type field-effect duplication transistor having its source connected to the bias voltage and having its drain connected to said column, the gates of the transistors of each branch being interconnected.

5. The device of claim 4, wherein the first measurement circuit comprises, for each column, a PMOS-type field-effect protection transistor having its source connected to the bias voltage and having its gate connected to the drain of the duplication transistor of the duplication branch associated with said column and an NMOS-type field effect measurement transistor, having its drain connected to the drain of the protection transistor and having its gate connected to the column, the sources of the measurement transistors being connected to a measurement point.

6. The device of claim 5, wherein the reference branch further comprises a PMOS-type field-effect reference power transistor having its source connected to the drain of the reference transistor, the gate and the drain of the reference power transistor being connected to the reference current source, wherein each duplication branch further comprises a PMOS-type field-effect duplication power transistor having its source connected to the drain of the duplication transistor and having its drain connected to the column, and the gate of which is connected to the drain of the reference power transistor for selecting said column, the first comparison signal being the voltage at the drain of the reference power transistor.

7. The device of claim 4, wherein the second measurement circuit comprises, for each column, a PMOS-type field-effect measurement transistor having its drain connected to a reference voltage and having its gate connected to the column, the sources of the measurement transistors being connected to a measurement point.

8. The device of claim 7, wherein the second comparison signal is equal to the bias voltage decreased by a determined constant voltage.

9. A matrix display comprising light-emitting diodes distributed in lines and columns and column control circuits configured to select columns to turn on the light-emitting diodes of the selected columns and of a selected line, said matrix display further comprising a device for regulating the bias voltage of the column control circuits of claim 1.

10. A method for regulating the bias voltage of circuits for controlling columns of a matrix display formed of light-emitting diodes distributed in lines and in columns, the column control circuits being configured to select columns to turn on the light-emitting diodes of the selected columns and of a selected line of the matrix display, said method comprising measuring voltages of the selected columns, decreasing the bias voltage when a highest voltage among the measured voltages of the selected columns is smaller than a first comparison voltage and increasing the bias voltage when a single lowest voltage among the measured voltages of the selected columns is greater than a second comparison voltage.

11. The method of claim 10, wherein the column control circuits are made in the form of a current mirror comprising a reference branch and several duplication branches connected to the bias voltage, each duplication branch being connected to a column, the reference branch comprising a PMOS-type field-effect reference transistor having its source connected to the bias voltage, the gate and the drain of the reference transistor being interconnected, and a PMOS-type field-effect reference power transistor having its source connected to the drain of the reference transistor, the gate and the drain of the power transistor being connected to a reference current source providing a current equal to a predefined luminance current and wherein the first comparison signal is the voltage at the drain of the reference power transistor and the second comparison signal is the voltage at the drain of the reference transistor.

12. A circuit for regulating a bias voltage of column control circuits of a matrix display, the matrix display including light-emitting diodes arranged in lines and columns, the column control circuits configured to select columns to turn on the light-emitting diodes of a selected line, each selected column having an operating voltage, the circuit comprising:

a first measurement circuit configured to provide a first measurement signal representative of a maximum operating voltage among the operating voltages of the selected columns;

a second measurement circuit configured to measure the operating voltages of the selected columns and to provide a second measurement signal representative of a single minimum operating voltage among the operating voltages of the selected columns; and an adjustment circuit configured to receive the first and second measurement signals and configured to decrease the bias voltage of the column control circuits if the first measurement signal is less than a first comparison signal and to increase the bias voltage of the column control circuits if the second measurement signal is greater than a second comparison signal.

13. The circuit of claim 12, wherein the adjustment circuit comprises:

a first storage circuit configured to store the first measurement signal for at least the duration of the display of an image on the matrix display; and a second storage circuit configured to store the second measurement signal for at least the duration of the display of an image on the matrix display.

14. The circuit of claim 12, wherein the first measurement circuit includes a protection circuit configured to deactivate the first measurement circuit for each column associated with a non-conductive light-emitting diode.

15. The circuit of claim 12, wherein the column control circuits include a current mirror comprising a reference branch and several duplication branches connected to the bias voltage, each duplication branch being connected to a column.

16. The circuit of claim 15, wherein the first measurement circuit comprises, for each column, a P-type protection transistor having its source connected to the bias voltage and an N-type measurement transistor having its drain connected to the drain of the protection transistor and having its gate connected to the column, the sources of the N-type measurement transistors being connected to a first measurement point.

17. The circuit of claim 16, wherein the second measurement circuit comprises, for each column, a P-type measurement transistor having its drain connected to a reference voltage and having its gate connected to the column, the sources of the P-type measurement transistors being connected to a second measurement point.

18. The circuit of claim 17, wherein the second comparison signal is the bias voltage decreased by a constant voltage.

19. A method for regulating a bias voltage of column control circuits of a matrix display, the matrix display including light-emitting diodes arranged in lines and columns, the column control circuits being configured to select columns to turn on the light-emitting diodes of a selected line, the method comprising:

measuring operating voltages of the selected columns and providing a single measured maximum operating voltage and a single measured minimum operating voltage;

decreasing, by a control circuit, the bias voltage when the single measured maximum operating voltage of the operating voltages of the selected columns is less than a first comparison voltage; and increasing, by the control circuit, the bias voltage when the single measured minimum operating voltage of the operating voltages of the selected columns is greater than a second comparison voltage.

* * * * *

UNITED STATES PATENT AND TRADEMARK OFFICE

CERTIFICATE OF CORRECTION

PATENT NO. : 7,911,424 B2
APPLICATION NO. : 11/294945
DATED : March 22, 2011
INVENTOR(S) : Danika Chaussy et al.

It is certified that error appears in the above-identified patent and that said Letters Patent is hereby corrected as shown below:

Title Page;

Item (75) Inventors: should read; Danike Chaussy, Brie et Angonnes, (FR);
Céline Mas, Poisat (FR)

Signed and Sealed this
Thirty-first Day of May, 2011

David J. Kappos

David J. Kappos
*Director of the United States Patent and Trademark Office*